US011063353B2

(12) United States Patent
Woods, Jr.

(10) Patent No.: US 11,063,353 B2
(45) Date of Patent: Jul. 13, 2021

(54) E-FUSE PHASE SHIFTER AND E-FUSE PHASED ARRAY

(71) Applicant: GlaiveRF, Inc., Burlington, MA (US)

(72) Inventor: Wayne H. Woods, Jr., Burlington, MA (US)

(73) Assignee: GLAIVERF, INC., Burlington, MA (US)

( * ) Notice: Subject to any disclaimer, the term of this patent is extended or adjusted under 35 U.S.C. 154(b) by 27 days.

(21) Appl. No.: 16/570,497

(22) Filed: Sep. 13, 2019

(65) Prior Publication Data

US 2021/0083349 A1 Mar. 18, 2021

(51) Int. Cl.

| | |
|---|---|
| ***H01Q 3/30*** | (2006.01) |
| ***H01P 1/18*** | (2006.01) |
| ***H01Q 3/36*** | (2006.01) |
| ***H01P 3/08*** | (2006.01) |
| ***H01Q 3/32*** | (2006.01) |

(52) U.S. Cl.

CPC ..... *H01Q 3/30* (2013.01); *H01P 1/18* (2013.01); *H01P 3/081* (2013.01); *H01Q 3/32* (2013.01); *H01Q 3/36* (2013.01)

(58) Field of Classification Search

CPC .. H01P 1/18; H01P 1/184; H01P 1/185; H01P 1/122; H01P 9/00; H01Q 3/30; H01Q 3/32; H01Q 3/34; H01Q 3/36

USPC ..... 333/156, 164

See application file for complete search history.

(56) References Cited

U.S. PATENT DOCUMENTS

| | | | |
|---|---|---|---|
| 7,489,180 | B2 | 2/2009 | Marshall |
| 8,164,397 | B2 | 4/2012 | Wang et al. |
| 8,193,878 | B2 | 6/2012 | Ding et al. |
| 8,789,003 | B1 | 7/2014 | Ding et al. |
| 8,898,605 | B2 | 11/2014 | Ding et al. |
| 9,800,434 | B2 | 10/2017 | Ding et al. |
| 9,813,264 | B2 | 11/2017 | Ding et al. |
| 2013/0127564 | A1 | 5/2013 | Ding et al. |
| 2019/0089434 | A1 | 3/2019 | Rainish et al. |

OTHER PUBLICATIONS

Robson et al., "Electrically Programmable Fuse (eFUSE): From Memory Redundancy to Autonomic Chips", IEEE 2007 Custom Intergrated Circuits Conference (CICO), 2007, 6 pages.

Woods et al., "CMOS Millimeter Wave Phase Shifter Based on Tunable Transmission Lines", IEEE, 2013, 4 pages.

Tousi et al., "A Ka-band Digitally-Controlled Phase Shifter with sub-degree Phase Precision", 2016 IEEE Radio Frequency Integrated Circuits Symposium, 2016, 4 pages.

(Continued)

*Primary Examiner* — Benny T Lee

(74) *Attorney, Agent, or Firm* — Andrew D. Wright; Roberts Calderon Safran & Cole, P.C.

(57) ABSTRACT

A system utilizes e-fuses in phase shifter elements of a phased array antenna to achieve a desired direction of a beam formed by the phased array antenna. A phase shifter element includes: a transmission line structure comprising a signal line, a ground return line, a capacitance line, and an inductance return line; and at least one e-fuse connected to the transmission line structure, wherein the phase shifter element has a first phase shift when the at least one e-fuse is unbroken and a second phase shift, different from the first phase shift, when the at least one e-fuse is broken.

25 Claims, 9 Drawing Sheets

(56) References Cited

OTHER PUBLICATIONS

Sadhu et al., "A 28-GHz 32-Element TRX Phased-Array IC With Concurrent Dual-Polarized Operation and Orthogonal Phase and Gain Control for 5G Communications", IEEE Journal of Solid-State Circuits, vol. 52, No. 12, Dec. 2017, 19 pages.
Chen, "The Benefits of Antifuse OTP", Semiconductor Engineering, Dec. 19, 2016, 10 pages.
Benson, "Phased Array Beamforming ICs Simplify Antenna Design", Analog Devices, Jan. 2019, 4 pages.
Anonymous, "Phased Array Antenna", Radar Basics, http://www.radartutorial.eu/06.antennas/Phased%20Array%20Antenna.en.html, Accessed Aug. 15, 2019, 3 pages.

E-FUSE PHASE SHIFTER AND E-FUSE PHASED ARRAY

BACKGROUND

The present invention relates generally to wireless communication systems and, more particularly, to a system that utilizes e-fuses in phase shifter elements of a phased array antenna to achieve a desired direction of a beam formed by the phased array antenna.

Phase shifters are a component of phased array antenna systems which are used to directionally steer radio frequency (RF) beams for electronic communications or radar. A phased array antenna is a group of antennas in which the relative phases of the respective signals feeding the antennas are varied in such a way that the effective radiation pattern of the array is reinforced in a desired direction and suppressed in undesired directions. The relative amplitudes of, and constructive and destructive interference effects among, the signals radiated by the individual antennas determine the effective radiation pattern of the array. By controlling the radiation pattern through the constructive and destructive superposition of signals from the different antennas in the array, phased array antennas electronically steer the directionality of the antenna system, referred to as "beam forming" or "beam steering". In such systems, the direction of the radiation (i.e., the beam) can be changed by manipulating the phase of the signal fed into each individual antenna of the array, e.g., using a phase shifter.

Generally speaking, a phased array antenna can be characterized as an active beam steering system. Active beam steering systems have actively tunable phase shifters at each individual antenna element to dynamically change the relative phase among the elements and, thus, are capable of changing the direction of the beam plural times. Tunable transmission line (t-line) phase shifters are one way of implementing such actively tunable phase shifters. Tunable t-line phase shifters typically employ powered elements, such as switches, that change the state of an element within the phase shifter to change the phase of the signal that is passing through the phase shifter. However, typical tunable t-line phase shifters significantly attenuate signals passing through the tunable t-line phase shifters by about 6 dB to 8 dB at 60 GHz (e.g., more than a factor of four signal reduction traversing a tunable t-line phase shifter).

SUMMARY OF ASPECTS OF THE INVENTION

In a first aspect of the invention, there is a phase shifter element comprising: a transmission line structure comprising a signal line, a ground return line, a capacitance line, and an inductance return line; and at least one e-fuse connected to the transmission line structure, wherein the phase shifter element has a first phase shift when the at least one e-fuse is unbroken and a second phase shift, different from the first phase shift, when the at least one e-fuse is broken.

In another aspect of the invention, there is a phased array comprising: plural phase shifters respectively connected to plural antenna elements. Each of the plural phase shifters comprises plural phase shifter elements. Each of the plural phase shifter elements comprises a transmission line structure whose phase shift is configurable by at least one e-fuse in the transmission line structure.

In another aspect of the invention, there is a method comprising: determining a desired direction of a phased array antenna; and selectively blowing one or more e-fuses in plural phase shifters of the phased array antenna to set respective phase shifts in the plural phase shifters to achieve the desired direction of the phased array antenna.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION OF ASPECTS OF THE INVENTION

The present invention relates generally to wireless communication systems and, more particularly, to a system that utilizes e-fuses in phase shifter elements of a phased array antenna to achieve a desired direction of a beam formed by the phased array antenna. According to aspects of the invention, selected e-fuses in phase shifter elements of a phased array antenna are blown to perform a one-time programming of the phase shifter elements, which results in a beam that is directed in a fixed direction. In embodiments, the system receives or obtains data that defines a desired direction of the beam, and then blows certain ones of the e-fuses to achieve a beam that is directed in the desired direction. In this manner, implementations of the invention achieve the benefits of beam steering without suffering the attenuation experienced in active beam steering systems.

Beam steering advantageously increases the signal to noise ratio (SNR) of the antenna system up to an order of magnitude or more compared to antenna systems that do not employ beam steering. An increased SNR reduces the amount of power used by the antenna system to transmit the radiation to a receiving antenna, and also permits a higher bandwidth in communication. As a result, beam steering systems have become a focus of the next-generation wireless communication systems including fifth generation (5G). For example, it is envisioned that 5G systems will utilize fixed-location base stations (e.g., antennas) that steer beams toward users' wireless devices (e.g., smartphones, etc.) on an as-needed basis.

However, some antenna systems contain power-sensitive sensors (or circuits) and do not need to steer the communication beam more than once after the antenna system is installed. For these applications, beam steering is desired to realize the advantageous SNR, but the power sacrifice (e.g., attenuation) of active beam steering systems (e.g., such as those employing tunable t-line phase shifters) is not acceptable within the design parameters. To address this need, embodiments of the invention utilize phase shifters that include one-time programmable e-fuses, such that the direction of a beam formed by a phased array antenna employing the phase shifters is set once, and only once, by selectively blowing certain ones of the e-fuses in the phase shifters.

In accordance with aspects of the invention, the e-fuse phase shifters, and phased array systems that employ them, provide a large power consumption savings over actively tunable phase shifters. In some embodiments, the e-fuse phase shifters are automatically set by the system. In these embodiments, the phased array systems that employ the e-fuse phase shifters can be arbitrarily placed in an environment, and the beam can be self-directed to point in the direction of the nearest neighbor transceiver without having to be manually set (e.g., by a human or drone) when installing the system in the environment.

Figure 1:
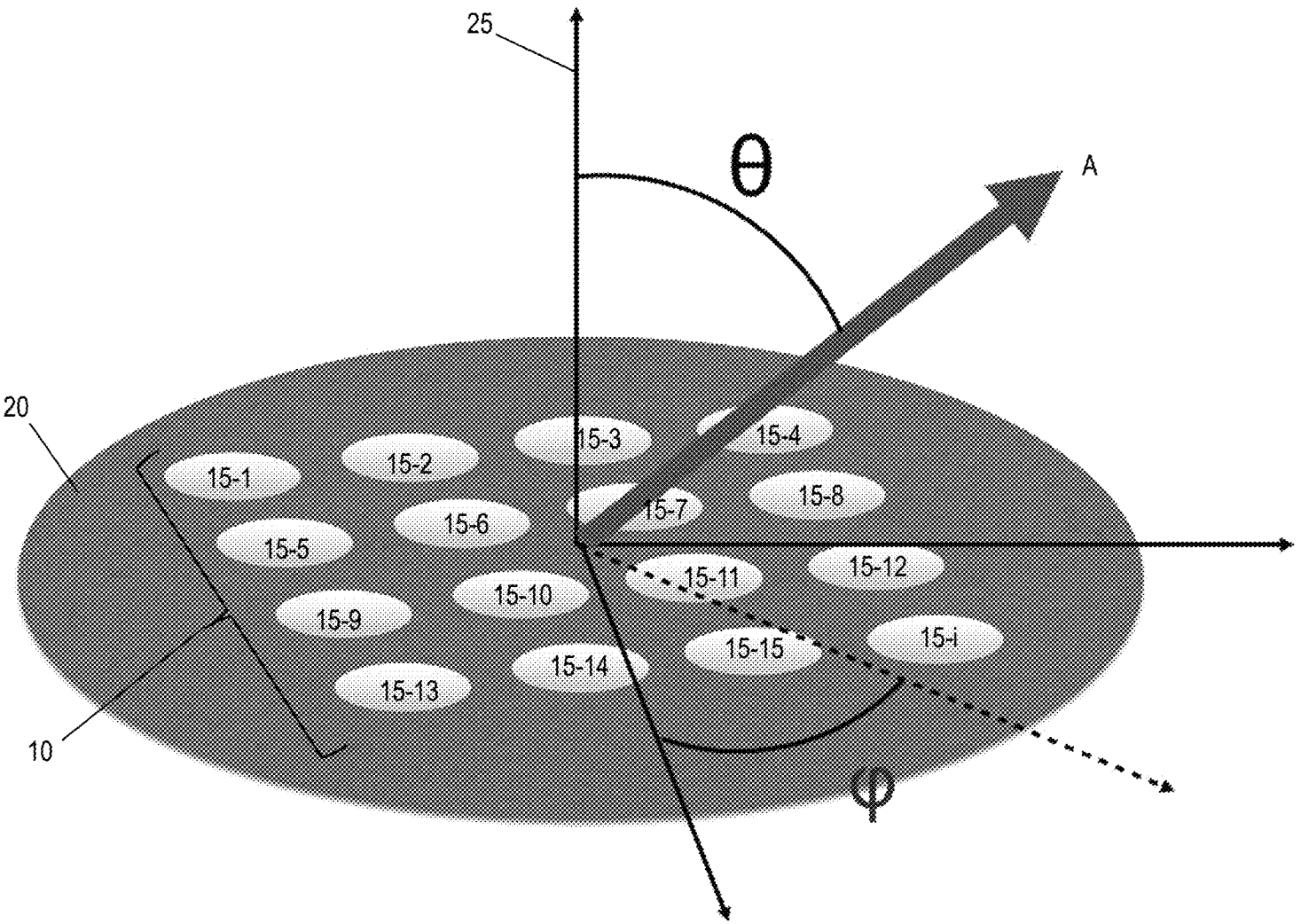
FIG. 1 shows an exemplary phased array antenna system in accordance with aspects of the invention.

FIG. 1 shows an exemplary phased array antenna system in accordance with aspects of the invention. In the example shown in FIG. 1, the phased array antenna system 10 comprises a 4×4 array of antenna elements 15-1, 15-2, 15-3, 15-4, 15-5, 15-6, 15-7, 15-8, 15-9, 15-10, 15-11, 15-12, 15-13, 15-14, 15-15, **15-*i* included in a coin-shaped sensor 20. In this example "i" equals sixteen; however, the number of antenna elements shown in FIG. 1 is not intended to be limiting, and the phased array antenna system 10 may have a different number of antenna elements. Similarly, the implementation in the coin-shaped sensor 20 is only for illustrative purposes, and the phased array antenna system 10** may be implemented in different structures.

Still referring to FIG. 1, the arrow "A" represents a direction of the beam that is formed by the phased array antenna system 10 using constructive and destructive superposition of signals from the antenna elements 15-1, 15-2, . . . , **15-*i* using beam steering principles. Angle θ represents the polar angle and angle φ represents the azimuth angle of the direction of the arrow A relative to a frame of reference 25 defined with respect to the phased array antenna system 10**.

Figure 2:
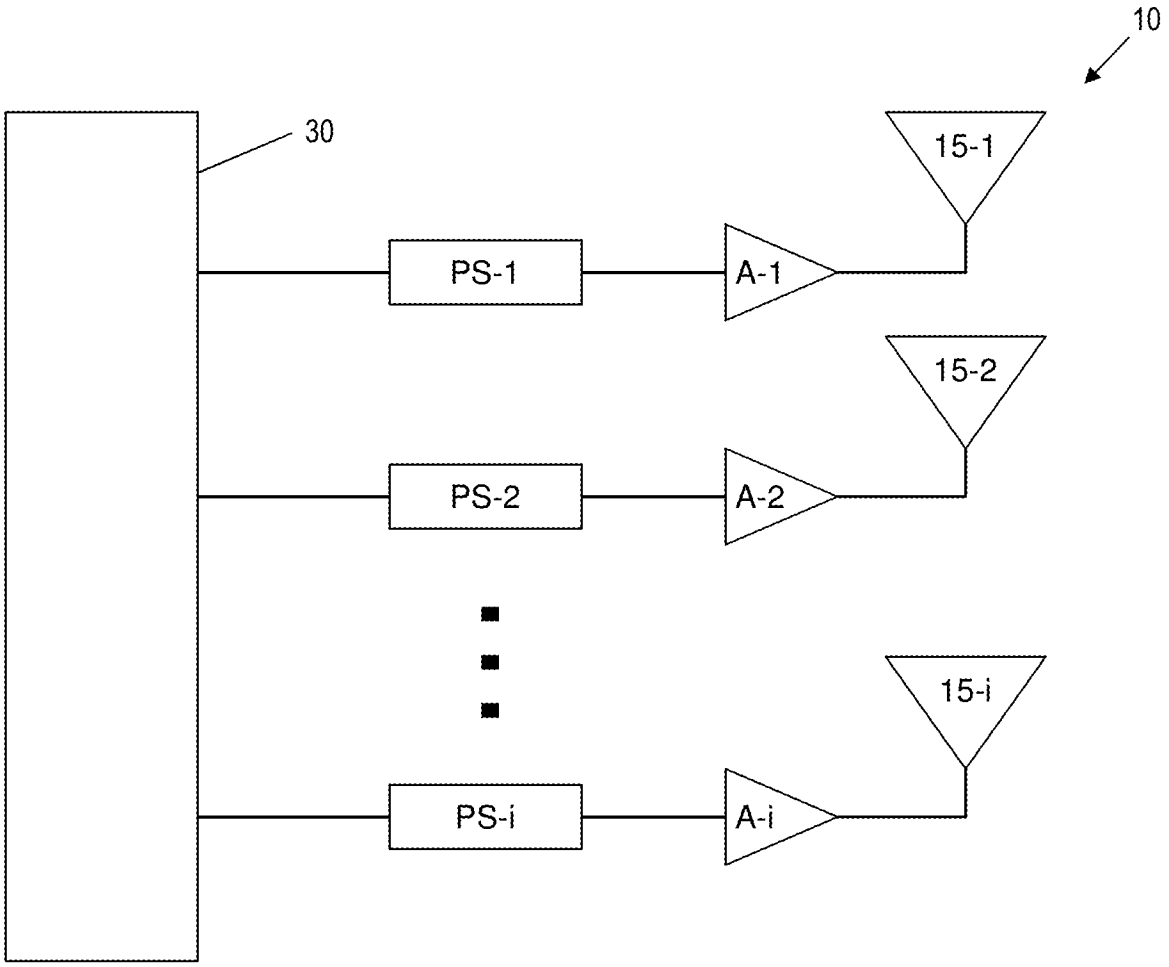
FIG. 2 shows a block diagram of an arrangement of components within the phased array antenna system in accordance with aspects of the invention.

FIG. 2 shows a block diagram of an arrangement of components within the phased array antenna system 10 in accordance with aspects of the invention. In embodiments, a respective phase shifter PS-1, PS-2, . . . , PS-i and amplifier A-1, A-2, . . . , A-i are connected to each respective one of the antenna elements 15-1, 15-2, . . . , **15-*i*. In particular embodiments, the respective phase shifter PS-1, PS-2, . . . , PS-i and amplifier A-1, A-2, . . . , A-i are connected in series upstream of the respective one of the antenna elements 15-1, 15-2, . . . , 15-*i* as shown in FIG. 2. In implementations, a respective transmission signal is provided to each of the phase shifters PS-1, PS-2, . . . , PS-i, e.g., from a power splitter 30 such as a Wilkinson power divider. In accordance with aspects of the invention, a respective phase shifter (e.g., PS-i) shifts the phase by an amount that is set by programming e-fuses of phase shifter elements within the phase shifter (PS-i), the amplifier (A-i) amplifies the phase shifted signal, and the antenna element (15-*i***) transmits the amplified and phase shifted signal.

Figure 3:
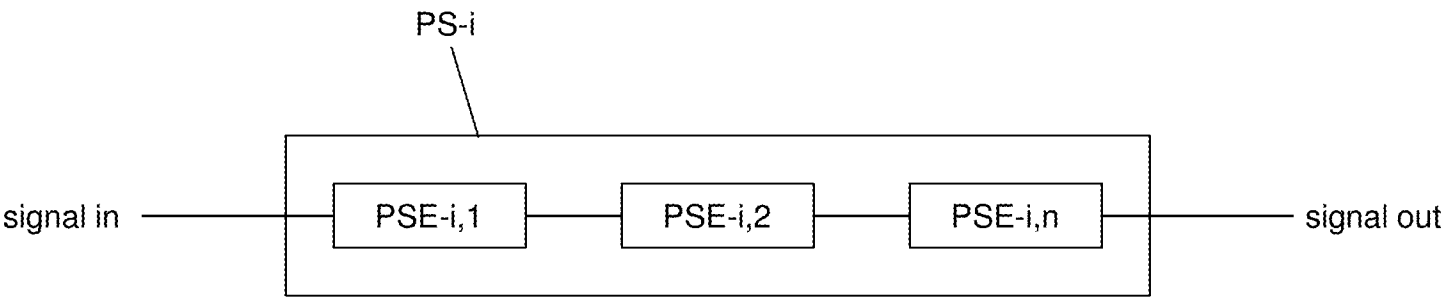
FIG. 3 shows a block diagram of an arrangement of phase shifter elements within a respective one of the phase shifters in accordance with aspects of the invention.

FIG. 3 shows a block diagram of an arrangement of phase shifter elements PSE-i,1, PSE-i,2, . . . , PSE-i,n within a respective one of the phase shifters PS-i in accordance with aspects of the invention. In embodiments, the phase shifter elements PSE-i,1, PSE-i,2, . . . , PSE-i,n are electrically connected in series in the phase shifter PS-i as depicted in FIG. 3. The number "n" of phase shifter elements may be any desired number. In a particular embodiment n=14; however, other numbers of phase shifter elements may be used in implementations of the invention. According to aspects of the invention, each one of the phase shifter elements PSE-i,1, PSE-i,2, . . . , PSE-i,n comprises a respective transmission line (t-line) structure as described with respect to FIG. 4.

Figure 4:
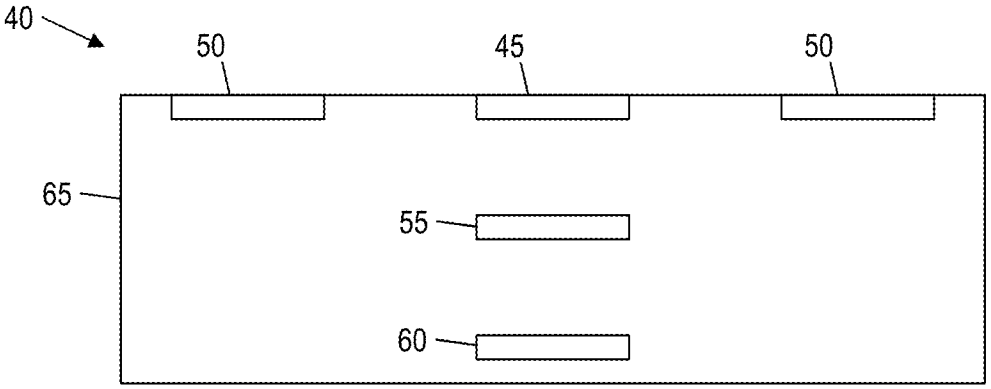
FIG. 4 shows a diagram of a cross section of a transmission line structure of a representative one of the phase shifter elements in accordance with aspects of the invention.

FIG. 4 shows a diagram of a cross section of a transmission line structure 40 of a representative one of the phase shifter elements PSE-i,n as depicted in FIG. 3 and in accordance with aspects of the invention. The transmission line structure 40 may be formed in a chip or substrate. The chip may be a monolithic crystal or semiconductor-on-insulator substrate having the transmission line structure 40 formed thereon, or may be a multi-layer printed circuit board. In embodiments, the transmission line structure 40 comprises a signal line 45, at least one ground return line 50, a capacitance line 55, and an inductance return line 60.

In the example shown in FIG. 4, the transmission line structure 40 is in the form of a coplanar waveguide (CPW) structure with the signal line 45 and two ground return lines 50 formed in a same level and running parallel to one another. In this example, the capacitance line 55 comprises capacitance crossing lines that are below the signal line 45 and that cross orthogonally to the signal line 45. The capacitance line 55 does not significantly affect the signal inductance since it is primarily orthogonal to the signal line 45. In this example, the inductance return line 60 is below the capacitance line 55, runs parallel to the signal line 45, and provides inductance control for the transmission line structure 40. The lines 45, 50, 55, 60 are composed of metal or other electrical conductor material formed in one or more layers of dielectric material 65, e.g., in a layered semiconductor structure or a printed circuit board. It is noted that the depicted arrangement of the transmission line structure 40 is merely for illustration; implementations of the invention are not limited to this particular arrangement, and other arrangements of a transmission line structure may be used in embodiments.

Figure 5:
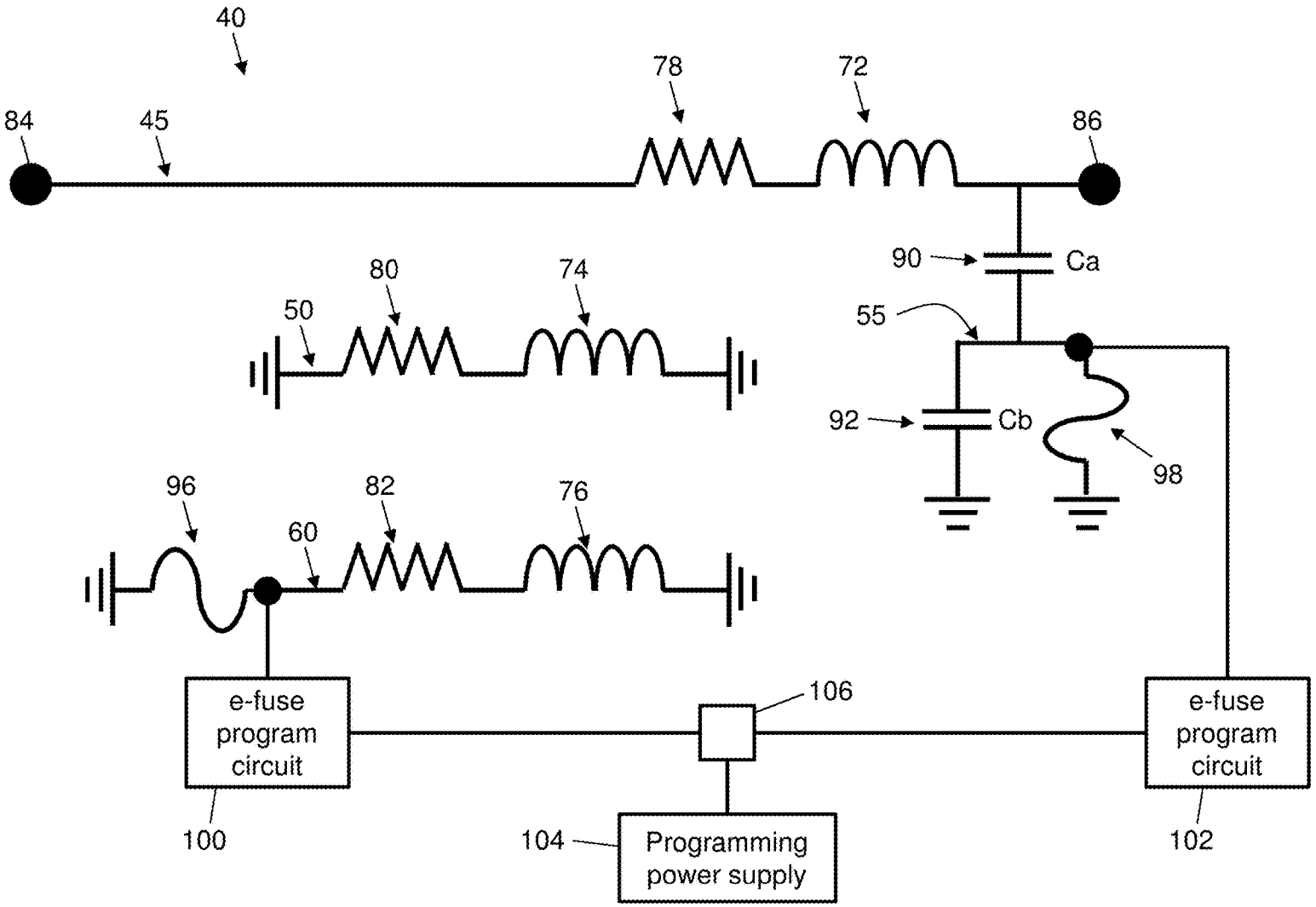
FIG. 5 shows a schematic diagram of a transmission line structure of a representative one of the phase shifter elements in accordance with aspects of the invention.

FIG. 5 shows a schematic diagram of a transmission line structure 40 of a representative one of the phase shifter elements PSE-i,n in accordance with aspects of the invention. An inductance 72 represents the self-inductance of the signal line 45, an inductance 74 represents the self-inductance of the ground lines 50, and an inductance 76 represents the self-inductance of the inductance return line 60. Coupling inductances exist between these lines as well, with a mutual inductance between the signal line 45 and the inductance return line 60, a mutual inductance between the signal line 45 and the ground lines 50, and a mutual inductance between the ground lines 50 and the inductance return line 60.

Still referring to FIG. 5, resistance 78 represents the resistance of the signal line 45, resistance 80 represents the resistance of the ground lines 50, and resistance 82 represents the resistance of the inductance return line 60, as defined by their materials and geometries. Capacitance 90

(with a value of Ca) represents a capacitance between the signal line 45 and the capacitance line 55, and capacitance 92 (with a value of Cb) represents a capacitance between the capacitance line 55 and the inductance return line 60.

With continued reference to FIG. 5, node 84 represents the "signal in" node (FIG. 3) and node 86 represents the "signal out" node (FIG. 3) for the transmission line structure 40 for this phase shifter element PSE-i,n. When the phase shifter elements PSE-i,1, PSE-i,2, . . . , PSE-i,n are electrically connected in series in the phase shifter PS-i as depicted in FIG. 3, the node 86 of phase shifter element PSE-i,1 is connected to node 84 of phase shifter element PSE-i,2 and so on. Moreover, the input node 84 of phase shifter element PSE-i,1 is connected to (and receives the signal from) the power splitter 30 as shown in FIG. 2. Additionally, the output node 86 of the phase shifter element PSE-i,n is connected to (and provides the phase shifted signal to) the amplifier A-i as shown in FIG. 2. In this manner, the phase shift of the signal passing through any one phase shifter PS-i is the cumulative result of all the phase shifts applied by the respective phase shifter elements PSE-i,1, PSE-i,2, . . . , PSE-i,n within that phase shifter PS-i.

According to aspects of the invention, and as shown in FIG. 5, at least one e-fuse 96 is connected between one end of the inductance return line 60 and ground, and at least one e-fuse 98 is connected between one end of the capacitance line 55 and ground. Each e-fuse 96, 98 is a link that is initially formed as a continuous (i.e., unbroken) strip of conductor material that provides an electrically conductive state across the e-fuse. Each respective e-fuse 96, 98 can be purposefully broken (e.g., blown using electrical energy) to create a permanent highly resistive state across the e-fuse. The e-fuse 96 is referred to as an inductance e-fuse, and the e-fuse 98 is referred to as an capacitance e-fuse.

In embodiments, the energy to blow the e-fuse 96 is controlled and applied by e-fuse program circuit 100, and the energy to blow the e-fuse 98 is controlled and applied by e-fuse program circuit 102. Each of the program circuits 100, 102 may be electrically connected to a programming power supply 104. In some embodiments, the programming power supply 104 is a power supply that is dedicated solely to blowing the e-fuses 96, 98. In a particular embodiment, a breakable element 106 is connected between the program circuits 100, 102 and the programming power supply 104 and can be broken by the programming power supply 104 to permanently disconnect the programming power supply 104 from the program circuits 100, 102, e.g., after the e-fuses 96, 98 have been selectively programmed in a desired manner.

In operation, the open or closed state of the e-fuse 96 affects the signal inductance (referred to herein as "L"), and the open or closed state of the e-fuse 98 affects the signal capacitance (referred to herein as "C") in the transmission line structure. For example, when the e-fuse 96 is unbroken (i.e., conductive), return current flows in the inductance return line 60 and signal inductance (L) is in a low state ($L_{low}$). On the other hand, when the e-fuse 96 is broken/blown (i.e., resistive), return current does not flow in the inductance return line 60 such that signal inductance (L) is in a high state ($L_{high}$). Similarly, when the e-fuse 98 is unbroken (i.e., conductive), the signal capacitance (C) is equal to that of capacitance 90 (e.g., Ca), which is a high capacitance state ($C_{high}$). On the other hand, when the e-fuse 98 is broken/blown (i.e., resistive), then the signal capacitance (C) equals (Ca*Cb)/(Ca+Cb), which equals Ca/2 when Ca=Cb, and which is a low capacitance state ($C_{low}$). This is summarized in Table 1.

TABLE 1

| | e-fuse unbroken | e-fuse broken/blown |
|---|---|---|
| e-fuse 96 (inductance side) | $L_{low}$ | $L_{high}$ |
| e-fuse 98 (capacitance side) | $C_{high}$ | $C_{low}$ |

The phase shift (also referred to as the "delay") of the signal travelling from node 84 to node 86 is affected by the signal inductance (L) and the signal capacitance (C) according to the relation: delay ∝SQRT(L*C). Therefore, the phase shift of the signal travelling from node 84 to node 86 can be changed by blowing e-fuse 96, which changes the value of the signal inductance (L), and/or blowing e-fuse 98, which changes the value of the signal capacitance (C).

In a particular embodiment, in order to maintain a substantially constant characteristic impedance of the signal line 45, the elements of the transmission line structure 40 are sized and shaped such that $(L_{high}/L_{low})=(C_{high}/C_{low})$. The characteristic impedance of the signal line 45 is defined as $Zo=SQRT(L_{low}/C_{low})=SQRT(L_{high}/C_{high})$. In this embodiment, to maintain a substantially constant characteristic impedance for different amounts of delay, the transmission line structure 40 of the phase shifter element PSE-i,n is programmed in only one of two configurations: (i) the e-fuse 96 is left unbroken (not blown) and the e-fuse 98 is broken/blown to provide a fast state, e.g., a smaller delay given by $delay=SQRT(L_{low}*C_{low})$; and (ii) the e-fuse 96 is broken/blown and the e-fuse 98 is left unbroken (not blown) to provide a slow state, e.g., a larger delay given by $delay=SQRT(L_{high}*C_{high})$. This is summarized in Table 2.

TABLE 2

| | Fast state of PSE-i, n | Slow state of PSE-i, n |
|---|---|---|
| e-fuse 96 (inductance side) | unbroken | broken/blown |
| e-fuse 98 (capacitance side) | broken/blown | unbroken |
| delay (phase shift) | $SQRT(L_{low}*C_{low})$ | $SQRT(L_{high}*C_{high})$ |
| characteristic impedance | $SQRT(L_{low}/C_{low})$ | $SQRT(L_{high}/C_{high})$ |

Aspects of the invention are not limited to configuring the e-fuses 96, 98 in only the two states described above. In some embodiments, the e-fuses 96, 98 may be configured in one of four possible states, as summarized in Table 3.

TABLE 3

| | First delay state of PSE-i, n | Second delay state of PSE-i, n | Third delay state of PSE-i, n | Fourth delay state of PSE-i, n |
|---|---|---|---|---|
| e-fuse 96 (inductance side) | unbroken | unbroken | broken/blown | broken/blown |
| e-fuse 98 (capacitance side) | unbroken | broken/blown | unbroken | broken/blown |

In this manner, each one of the phase shifter elements PSE-i,n in a single phase shifter PS-i can be programmed using the e-fuses 96, 98 to provide one of four different delay states, i.e., to impart one of four different phase shifts on the signal passing through the phase shifter elements. As is apparent from the foregoing description, each one of the phase shifter elements PSE-i,n includes at least one e-fuse 96, 98 connected to the transmission line structure, wherein the phase shifter element has a first phase shift (e.g., delay) when the at least one e-fuse 96, 98 is unbroken and a second phase shift (e.g., delay), different from the first phase shift, when the at least one e-fuse 96, 98 is broken. In embodiments when the number "n" of phase shifter elements PSE-i,n equals fourteen, a single phase shifter PS-i comprising the fourteen phase shifter elements PSE-i,n provides a wide range of different phase shift values that can be selectively applied to the signal passing through the phase shifter PS-i. In this manner, each one of the phase shifters PS-1, PS-2, . . . , PS-i can be individually configured, by appropriately programming the e-fuses 96, 98 in its phase shifter elements PSE-i,1, PSE-i,2, . . . , PSE-i,n, to achieve a desired phase shift for the signal that is provided to its associated antenna element, such that the combination of signals emitted by the respective antenna elements 15-1, 15-2, . . . , **15-*i* forms a beam in a desired direction A as shown in FIG. 1**.

In a particular embodiment, a memory included in the system stores data that defines which e-fuses 96, 98 to blow and which to maintain as unbroken for plural different combinations of values of angle θ (i.e., the polar angle of the direction of the arrow A as depicted in FIG. 1) and angle φ (i.e., the azimuth angle of the direction of the arrow A as depicted in FIG. 1). In this embodiment, for a desired combination of values of angles θ and φ, the system uses the stored data to determine which e-fuses 96, 98 to blow and which to maintain as unbroken (for each of the phase shifter elements PSE-i,1, PSE-i,2, . . . , PSE-i,n included in each of the phase shifters PS-1, PS-2, . . . , PS-i) to achieved the desired combination of values of angles θ and φ. In this manner, once the desired direction of the phased array antenna system 10 is determined (e.g., as defined by particular a combination of values of angles θ and φ), the system performs a one-time programming of the appropriate e-fuses 96, 98 in the phase shifter elements PSE-i,1, PSE-i,2, . . . , PSE-i,n included in each of the phase shifters PS-1, PS-2, . . . , PS-i to achieve this desired direction. Because e-fuses 96, 98 that are blown/broken by this programming cannot be reversed to an unbroken conductive state, this programming can only be performed one single time for the phased array antenna system 10.

Figure 6:
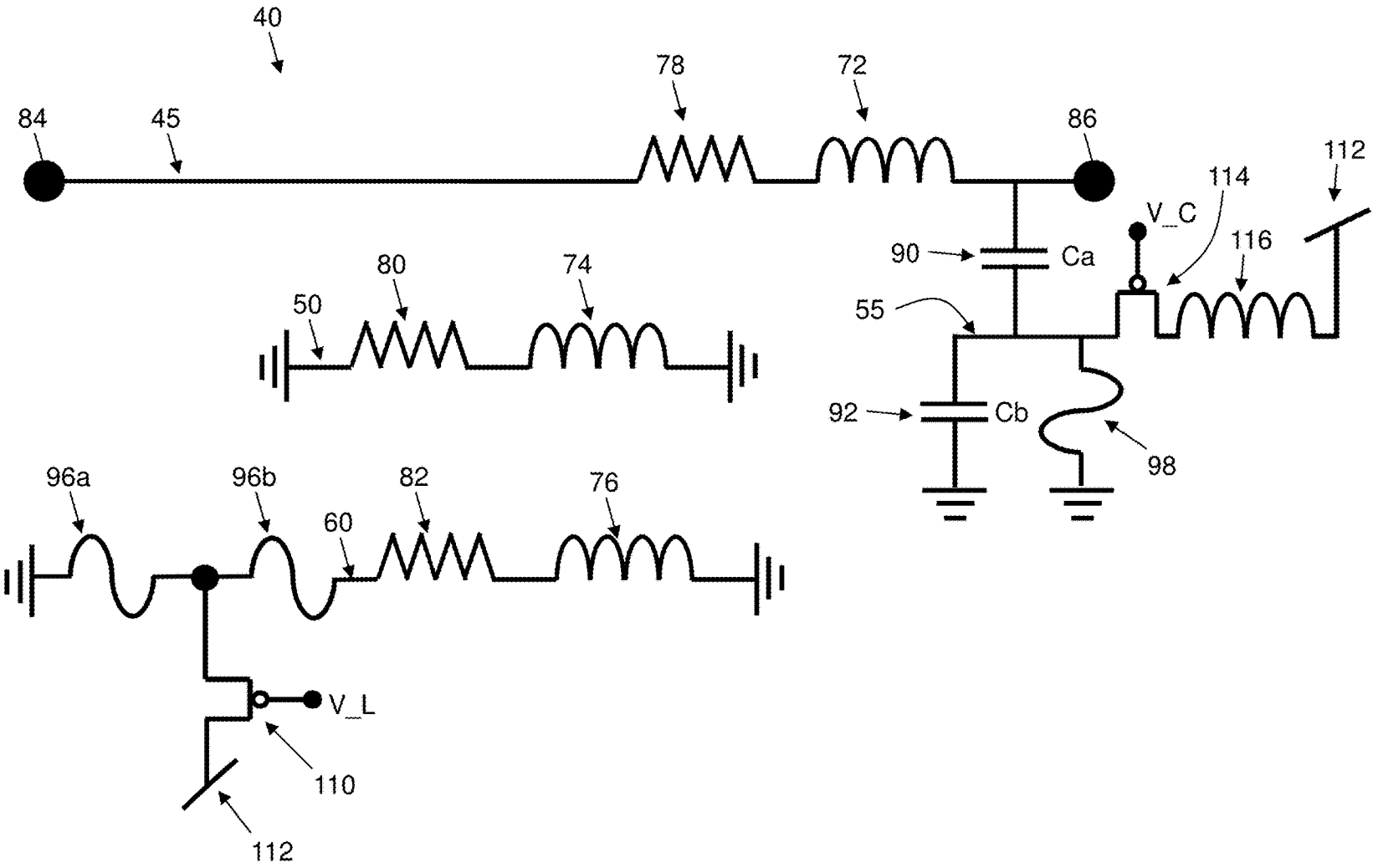
FIG. 6 shows a schematic diagram of a first exemplary control circuit for the transmission line structure in accordance with aspects of the invention.

FIG. 6 shows a schematic diagram of a first exemplary control circuit for the transmission line structure 40 as depicted in FIG. 5 (and in which same reference labels in FIG. 6 refer to the same elements as described in FIG. 5) in accordance with aspects of the invention. As shown in FIG. 6, in this embodiment, the inductance side e-fuse includes a first e-fuse **96*a* and a second e-fuse 96*b* connected in series between ground and the inductance return line 60. In this implementation, the inductance side control circuit (e.g., the e-fuse program circuit 100 as depicted in FIG. 5) comprises a transistor 110 connected between a power supply 112 (e.g. from programming power supply 104 as depicted in FIG. 5) and a node between the first e-fuse 96*a* and the second e-fuse 96*b*. The transistor 110 is controlled (i.e., turned ON or OFF) by a voltage V_L that can be set to high or low by a control circuit. When the voltage V_L is appropriate to turn OFF the transistor 110, the first e-fuse 96*a* and the second e-fuse 96*b* remain in the unbroken state (i.e., conductive), which causes the inductance to be in the low state ($L_{low}$). To change the inductance to the high state ($L_{high}$), the voltage V_L is set to the appropriate value to turn ON the transistor 110, which causes both the first e-fuse 96*a* and the second e-fuse 96*b*** to blow/break.

Still referring to FIG. 6, in this embodiment the capacitance side e-fuse comprises a single e-fuse 98 connected between the capacitance line 55 and ground. The capacitance side control circuit (e.g., the e-fuse program circuit 102 as depicted in FIG. 5) comprises a transistor 114 connected between the power supply 112 and the end of the e-fuse 98 that is not connected to ground. The transistor 114 is controlled (i.e., turned ON or OFF) by a voltage V_C that can be set to high or low by a control circuit. When the voltage V_C is appropriate to turn OFF the transistor 114, the e-fuse 98 remains in the unbroken state (i.e., conductive), which causes the capacitance to be in the high state ($C_{high}$). To change the capacitance to the low state ($C_{low}$), the voltage V_C is set to the appropriate value to turn ON the transistor 114, which causes the e-fuse 98 to blow/break. In a particular embodiment, the capacitance side control circuit includes an inductor 116 that provides a high-frequency block to the power supply 112.

Figure 7:
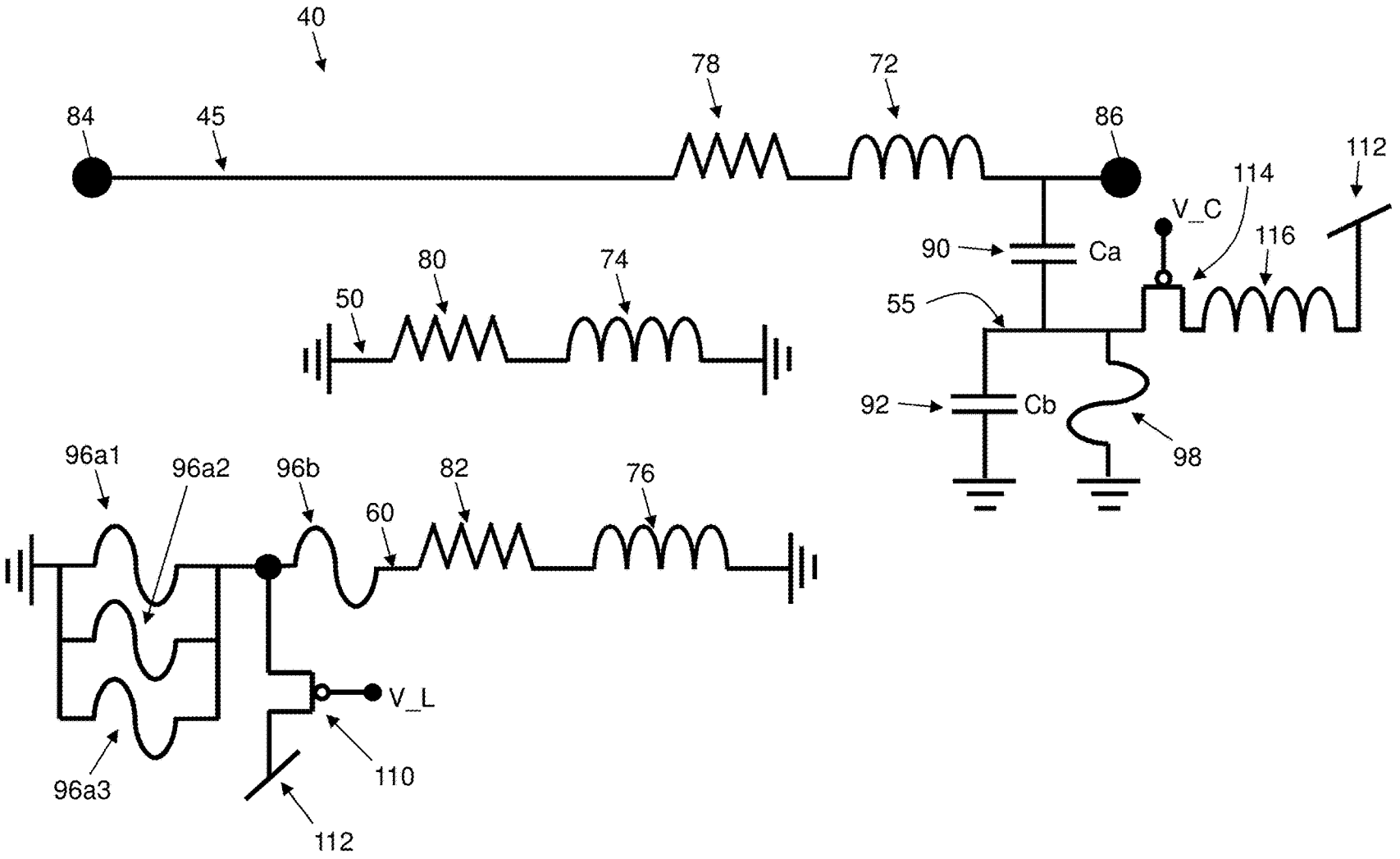
FIG. 7 shows a schematic diagram of a second exemplary control circuit for the transmission line structure in accordance with aspects of the invention.

FIG. 7 shows a schematic diagram of a second exemplary control circuit for the transmission line structure 40 as depicted in FIG. 5 (and in which same reference labels in FIG. 7 refer to the same elements as described in FIGS. 5 and 6) in accordance with aspects of the invention. The control circuit shown in FIG. 7 is the same as that shown in FIG. 6 except that in the control circuit shown in FIG. 7, the first e-fuse comprises three first e-fuses **96*a*1, 96*a*2, 96*a*3 connected in parallel. In this circuit, the second e-fuse 96*b* will blow first when the programming energy is applied via the transistor 110, and the three first e-fuses 96*a*1, 96*a*2, 96*a*3 will blow sometime after the second e-fuse 96*b* has already blown. Although three e-fuses 96*a*1, 96*a*2, 96*a*3** are shown, it is noted that other numbers of first e-fuses may be used in this embodiment.

The control circuits shown in FIGS. 6 and 7 are exemplary and are not intended to limit aspects of the invention. Other control circuits can be used to selectively blow (e.g., program) the e-fuses 96, 98 in other implementations of the invention.

Figure 8:
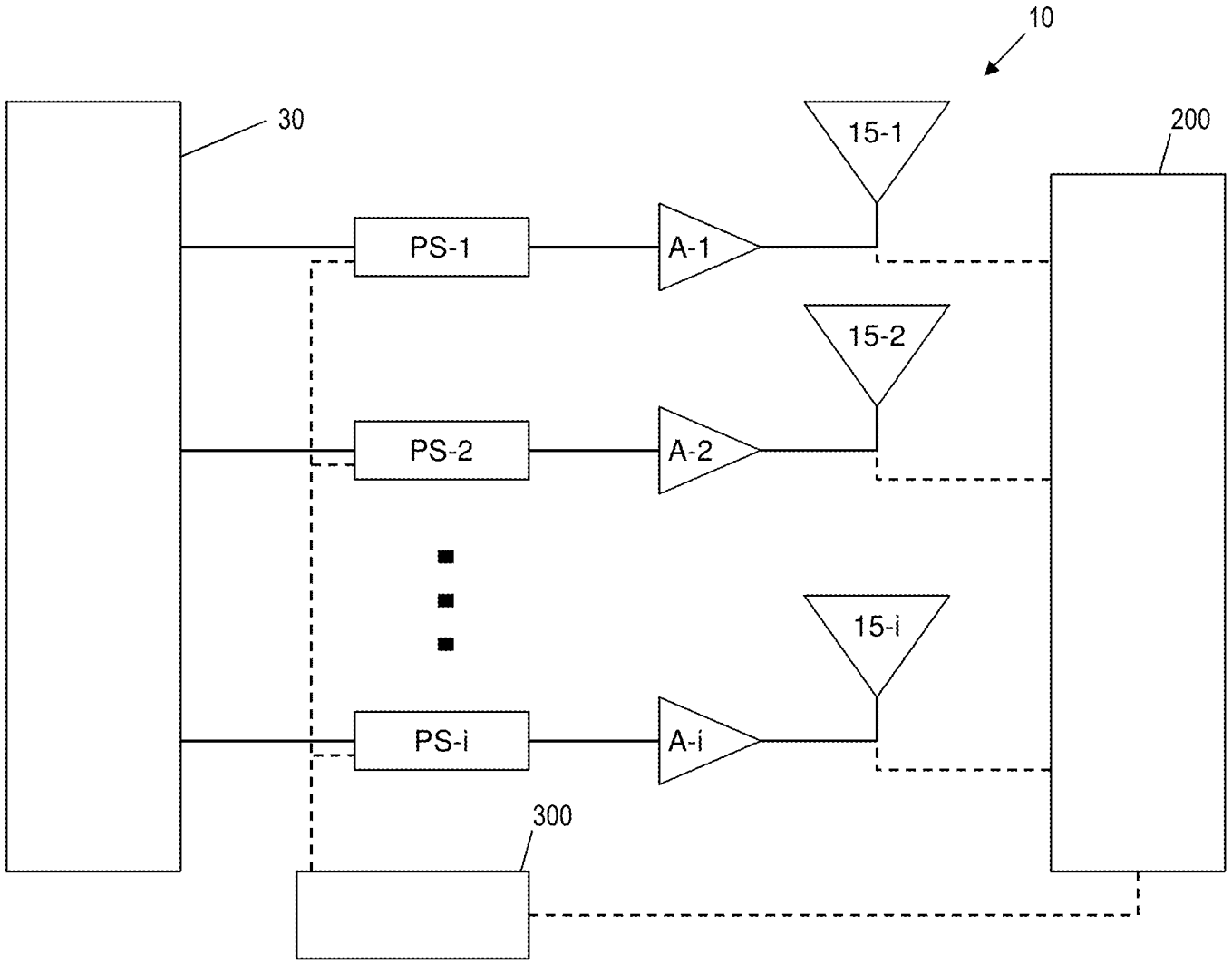
FIG. 8 shows an embodiment in accordance with aspects of the invention in which an actively tunable phase shifter is selectively connected to the respective antenna elements.

FIG. 8 shows an embodiment in accordance with aspects of the invention in which an actively tunable phase shifter 200 is selectively connected to the respective antenna elements 15-1, 15-2, . . . , **15-*i*. In the embodiment shown in FIG. 8, the phased array antenna system 10 comprises the elements as already described with respect to FIGS. 1-5 (and optionally FIG. 6 or FIG. 7). In the embodiment shown in FIG. 8, the actively tunable phase shifter 200 is a conventional phase shifter that is capable of automatically determining a direction of the phased array antenna system 10** as defined by particular a combination of values of angles θ and φ. Such automatic determination of a direction of a phased array antenna system is sometimes referred to as "self-installation" and/or "tracking" and is described, for example, in United States Patent Application Publication No. 2019/0089434, published Mar. 21, 2019, the contents of which are expressly incorporated by reference herein in their entirety.

In the embodiment shown in FIG. 8, a control circuit 300 receives data from the actively tunable phase shifter 200, the data defining a direction of the phased array antenna system 10 as defined by particular a combination of values of angles θ and y as depicted in FIG. 1. Using this data, the control circuit 300 provides respective control signals to the phase shifters PS-1, PS-2, . . . , PS-i, wherein the control signals cause the programming circuits 100, 102 (FIG. 5) in the phase shifter elements PSE-i,1, PSE-i,2, . . . , PSE-i,n to perform the one-time programming of the appropriate e-fuses 96, 98 in the phase shifter elements PSE-i,1, PSE-i,2, . . . , PSE-i,n to achieve the direction defined by the combination of values of angles θ and φ as depicted in FIG. 1. In this manner, the actively tunable system 200 is used to automatically determine the direction of the phased array antenna system 10 and, based on this determination, the control circuit 300 programs the e-fuses in the phase shifter elements PSE-i,1, PSE-i,2, . . . , PSE-i,n to apply appropriate phase shifts to achieve the direction determined by the actively tunable system 200. In this embodiment, after the one-time programming of the e-fuses in the phase shifter elements PSE-i,1, PSE-i,2, . . . , PSE-i,n, the actively tunable system 200 is tuned OFF to reduce the power used by the system. The actively tunable phase shifter 200 may be formed on-chip with the phased array antenna 10, e.g., on the same sensor 20 as depicted in FIG. 1.

Figure 9:
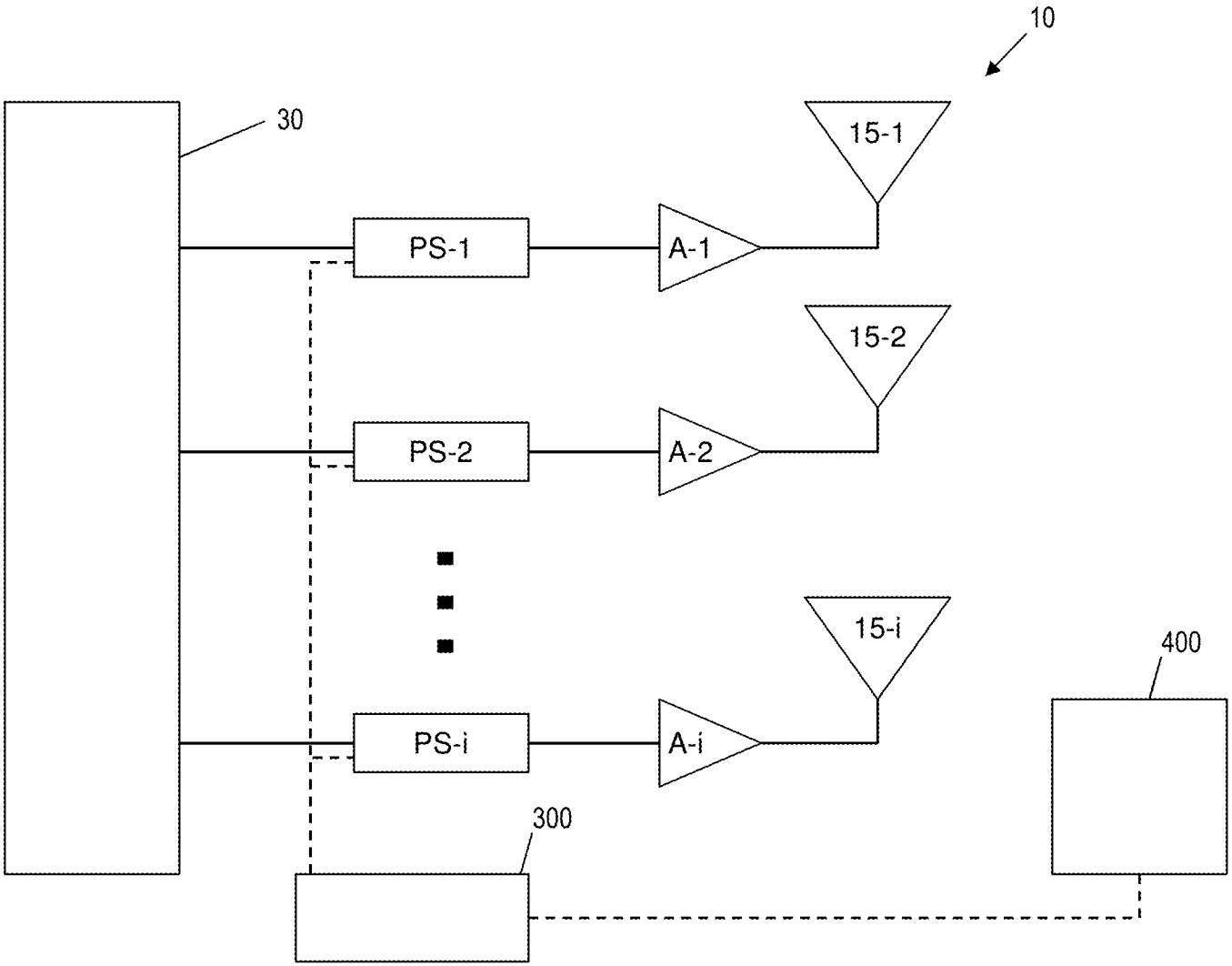
FIG. 9 shows an embodiment in accordance with aspects of the invention in which a user provides input to define a direction of the phased array antenna system.

FIG. 9 shows an embodiment in accordance with aspects of the invention in which a user provides input to define a direction of the phased array antenna system 10. In the embodiment shown in FIG. 9, the phased array antenna system 10 comprises the elements as already described with respect to FIGS. 1-5 (and optionally FIG. 6 or FIG. 7). In the embodiment shown in FIG. 9, the system comprises an input/output (I/O) system 400 by which a user may provide input to define a desired direction of the phased array antenna system 10. The I/O system 400 may comprise one or more of: a data port, a wireless communication system, a keypad, and a touchscreen display.

In the example of a data port, a user may connect a device to the data port to upload data via the I/O system 400, wherein the data defines the combination of values of angles θ and φ (FIG. 1) of the desired direction of the phased array antenna system 10. For example, a user may have a hand-held device that is used to determine or store the values of the angles θ and φ, and the user may connect this device to the I/O system 400, e.g., via a wire or cable, to transmit data to the control circuit 300, the transmitted data defining the values of angles θ and φ.

In the example of a wireless communication system, a user may use another device to wirelessly transmit data to the I/O system 400, wherein the data defines the combination of values of angles θ and φ of the desired direction of the phased array antenna system 10. For example, a separate device that is not part of the phased array antenna system 10 may be used to determine the values of the angles θ and φ, and this separate device may use wireless communication to transmit data defining the angles to the control circuit 300 via the I/O system 400. In this example, the I/O system 400 may comprise one or more antennas that provide wireless communication via one or more protocols including but not limited to: Bluetooth, WiFi, near field communication (NFC), and cellular.

In the example of a keypad and/or a touchscreen display, a user may manually provide input via the I/O system 400, wherein the data defines the combination of values of angles θ and φ of the desired direction of the phased array antenna system 10.

In the embodiment shown in FIG. 9, the control circuit 300 receives data from the I/O system 400, the data defining a direction of the phased array antenna system 10 as defined by particular a combination of values of angles θ and φ as depicted in FIG. 1. Using this data, the control circuit 300 provides respective control signals to the phase shifters PS-1, PS-2, . . . , PS-i, wherein the control signals cause the programming circuits 100, 102 in the phase shifter elements PSE-i,1, PSE-i,2, . . . , PSE-i,n to perform the one-time programming of the appropriate e-fuses 96, 98 (FIG. 5) in the phase shifter elements PSE-i,1, PSE-i,2, . . . , PSE-i,n to achieve the direction defined by the combination of values of angles θ and φ as depicted in FIG. 1. In this manner, the I/O system 400 is used to obtain data defining the direction of the phased array antenna system 10 and, based on this obtained data, the control circuit 300 programs the e-fuses in the phase shifter elements PSE-i,1, PSE-i,2, . . . , PSE-i,n to apply appropriate phase shifts to achieve the desired direction. In this embodiment, after the one-time programming of the e-fuses in the phase shifter elements PSE-i,1, PSE-i,2, . . . , PSE-i,n, the I/O system 400 is tuned OFF to reduce the power used by the system. The I/O system 400 may be formed on-chip with the phased array antenna 10, e.g., on the same sensor 20 as depicted in FIG. 1.

Figure 10:
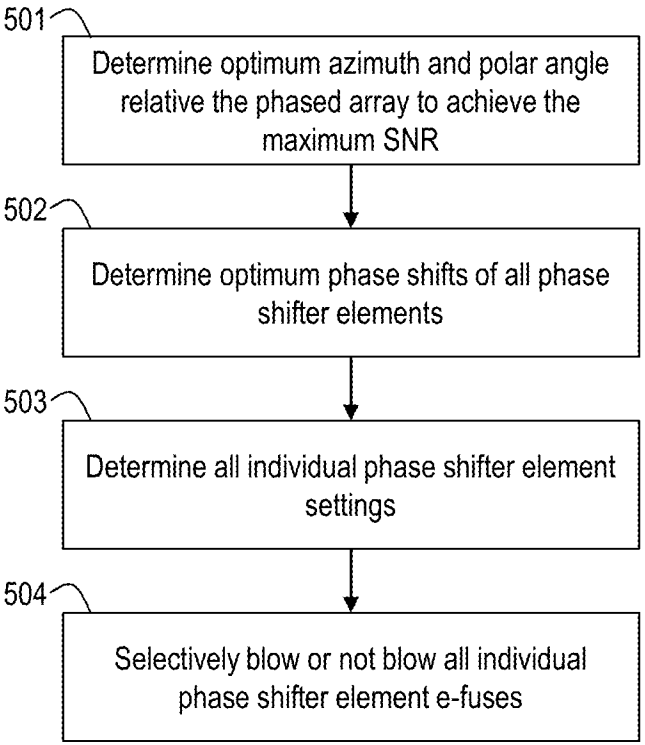
FIG. 10 shows a flowchart of an exemplary method in accordance with aspects of the invention.

FIG. 10 shows a flowchart of an exemplary method in accordance with aspects of the invention. In embodiments, the steps of the method are performed by or using elements already described herein, and the steps of the method are described using reference numbers of those elements when appropriate.

At step 501, the system determines an optimum azimuth and polar angle relative the phased array to achieve the maximum SNR. Step 501 may be performed automatically, e.g., as described with respect to FIG. 8, or manually, e.g., as described with respect to FIG. 9.

In an automated implementation of step 501, the sensor 20 (FIG. 1) can be placed randomly at a location (e.g., dropped from a drone, bolted to a signpost, etc.). An initial determination of the strongest direction of the communication signal source is performed automatically (e.g., by the actively tunable system 200) to determine the optimal azimuth angle φ and polar angle θ of the phased array antenna system 10. As described with respect to FIG. 8, the system 200 to determine the optimum angle possible can make use of the same array of antenna elements 15-1, 15-2, . . . , **15-*i* as the e-fuse phased array antenna system 10**, and may be turned OFF after it has determined the optimal azimuth angle φ and polar angle θ, i.e., to conserve power.

At step 502, the system determines optimum phase shifts of all the phase shifter elements PSE-i,1, PSE-i,2, . . . , PSE-i,n (FIG. 3). In embodiments, the control circuit 300 (FIG. 8) includes logic that is configured to determine optimum phase shifts of all the phase shifter elements PSE-i,1, PSE-i,2, . . . , PSE-i,n based on the optimal azimuth angle φ and polar angle θ from step 501.

At step 503, the system determines all individual phase shifter element settings. In embodiments, the control circuit 300 includes logic that is configured to determine the settings of each e-fuse in each of the phase shifter elements PSE-i,1, PSE-i,2, . . . , PSE-i,n to achieve the phase shifts determined at step 502.

In a particular embodiment, steps 502 and 503 are performed together. In this embodiment, the control circuit 300 accesses data stored in on-chip memory to determine all individual phase shifter element settings for a given azimuth angle φ and polar angle θ (from step 501). Implementations of the invention are not limited to this method, and other methods may be used to determine the settings of each e-fuse in each of the phase shifter elements PSE-i,1, PSE-i,2, . . . , PSE-i,n to achieve the optimal azimuth angle φ and polar angle θ of step 501.

At step 504, the system selectively blows or does not blow all individual phase shifter element e-fuses in accordance with the setting determined at step 503. In embodiments, and as described with respect to FIG. 5, the system uses e-fuse program circuits 100, 102 to selectively blow certain ones of the e-fuses 96, 98 to achieve a desired phase shift in each of the phase shifter elements PSE-i,1, PSE-i,2, . . . , PSE-i,n. The e-fuse program circuits 100, 102 may comprise the control circuits shown in FIG. 6 or FIG. 7, or some other circuit that is configured to selectively blow certain ones of the e-fuses 96, 98 to achieve a desired phase shift in each of the phase shifter elements PSE-i,1, PSE-i,2, . . . , PSE-i,n.

For example, in an alternative embodiment, the e-fuses of all of the individual phase shifter elements PSE-i,1, PSE-i,2, . . . , PSE-i,n are selectively blown or not blown using digital addressing, where the e-fuses 96, 98 in the phase shifter element arrays are treated similarly as e-fuse memory elements in an e-fuse memory array and blown or not blown based on a digitally addressed control signal (e.g., analogous to controlling/blowing an e-fuse memory array).

As should be apparent from the description herein, embodiments of the invention may be used to perform a method comprising: determining a desired direction of a phased array antenna 10; and selectively blowing one or more e-fuses 96, 98 in plural phase shifters PS-1, PS2, . . . , PS-i of the phased array antenna 10 to set respective phase shifts in the plural phase shifters to achieve the desired direction of the phased array antenna 10. In embodiments, each one of the plural phase shifters PS-1, PS2, . . . , PS-i comprises plural phase shifter elements phase shifter elements PSE-i,1, PSE-i,2, . . . , PSE-i,n, and the selectively blowing the one or more e-fuses 96, 98 comprises selectively blowing and not blowing individual e-fuses 96, 98 in each respective one of the plural phase shifter elements. The method may further comprise determining which ones of the e-fuses to blow and which ones of the e-fuses to not blow in each respective one of the plural phase shifter elements, e.g., by determining or obtaining the azimuth angle and the polar angle of the desired direction, and further determining which ones of the e-fuses should be blown to cause respective phases shifts to achieve a radiation pattern of the plural antenna elements that achieves the desired direction of the beam formed by the antenna elements. In some embodiments, the desired direction is determined automatically using an actively tunable phase shifter, e.g., as described with respect to FIG. 8, and the method may further comprise turning off the actively tunable phase shifter after the determining.

In accordance with further aspects of the invention, there is a method of manufacturing a phase shifter element as described herein. In accordance with further aspects of the invention, there is a method of manufacturing a phased array antenna that includes one or more phase shifter elements as described herein. The structures of the present invention, including the phase shifter element PSE-i,n comprising a transmission line structure 40 and e-fuses, can be manufactured in a number of ways using a number of different tools. In some embodiments that utilize semiconductor structures, the methodologies and tools are used to form structures with dimensions in the micrometer and nanometer scale. The methodologies, i.e., technologies, employed to manufacture the structures of the present invention have been adopted from integrated circuit (IC) technology. For example, the structures of the present invention are built on wafers and are realized in films of material patterned by photolithographic processes on the top of a wafer. In particular, the fabrication of the structures of the present invention uses three basic building blocks: (i) deposition of thin films of material on a substrate, (ii) applying a patterned mask on top of the films by photolithographic imaging, and (iii) etching the films selectively to the mask.

In some embodiments, the method(s) as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A phase shifter element, comprising:

a transmission line structure comprising a signal line, a ground return line, a capacitance line, and an inductance return line; and at least one e-fuse connected to the transmission line structure, wherein the phase shifter element has a first phase shift when the at least one e-fuse is unbroken and a second phase shift, different from the first phase shift, when the at least one e-fuse is broken.

2. The phase shifter element of claim 1, wherein the at least one e-fuse comprises at least one inductance e-fuse connected to the inductance return line and a capacitance e-fuse connected to the capacitance line.

3. The phase shifter element of claim 2, wherein the at least one inductance e-fuse comprises a first e-fuse and a second e-fuse connected in series and connected to the inductance return line.

4. The phase shifter element of claim 3, further comprising a transistor connected between a power supply and a node between the first e-fuse and a second e-fuse.

5. The phase shifter element of claim 2, wherein the at least one inductance e-fuse comprises a group of e-fuses connected to one another in parallel, and another e-fuse connected in series with the group of e-fuses.

6. The phase shifter element of claim 5, further comprising a transistor connected between a power supply and a node between the other another e-fuse and the group of e-fuses.

7. The phase shifter element of claim 2, further comprising a transistor connected to the capacitance e-fuse.

8. The phase shifter element of claim 7, further comprising an inductor connected between the transistor and a power supply.

9. The phase shifter element of claim 2, further comprising:

a first circuit connected to the at least one inductance e-fuse and that is configured to selectively break the at least one inductance e-fuse; and a second circuit connected to the capacitance e-fuse and that is configured to selectively break the capacitance e-fuse.

10. The phase shifter element of claim 2, wherein:

breaking the at least one inductance e-fuse changes a delay of the phase shifter element by changing a signal inductance; and breaking the capacitance e-fuse changes a delay of the phase shifter element by changing a signal capacitance.

11. The phase shifter element of claim 1, wherein the phase shifter element is one of plural phase shifter elements connected in series and connected to an antenna element.

12. The phase shifter element of claim 11, wherein the antenna element in one of plural antenna elements in a phased array antenna system.

13. A phased array, comprising:

plural phase shifters respectively connected to plural antenna elements, wherein:

each of the plural phase shifters comprises plural phase shifter elements; and each of the plural phase shifter elements comprises a respective transmission line structure whose phase shift is configurable by at least one e-fuse in the respective transmission line structure.

14. The phased array of claim 13, further comprising plural amplifiers, wherein a respective one of the plural amplifiers is connected between a respective one of the plural phase shifters and a respective one of the plural antenna elements.

15. The phased array of claim 13, further comprising a control circuit that is configured to program each of the plural phase shifters to achieve a direction of a beam.

16. The phased array of claim 15, wherein the direction of the beam is defined by an azimuth angle and a polar angle.

17. The phased array of claim 16, wherein the control circuit receives data defining the azimuth angle and the polar angle from an actively tunable phase shifter that is separate and distinct from the plural phase shifters.

18. The phased array of claim 16, wherein the control circuit receives data defining the azimuth angle and the polar angle from an input/output system.

19. The phased array of claim 13, wherein the at least one e-fuse comprises at least one inductance e-fuse and a capacitance e-fuse.

20. The phased array of claim 19, wherein for each respective phase shifter element of the plural phase shifter elements:

the at least one inductance e-fuse is configured to be broken to change a delay of the respective phase shifter element by changing a signal inductance; and the capacitance e-fuse is configured to be broken to change a delay of the respective phase shifter element by changing a signal capacitance.

21. A method, comprising:

determining a desired direction of a phased array antenna; and selectively blowing one or more e-fuses in plural phase shifters of the phased array antenna to set respective phase shifts in the plural phase shifters to achieve the desired direction of the phased array antenna.

22. The method of claim 21, wherein:

each one of the plural phase shifters comprises plural phase shifter elements; and the selectively blowing one or more e-fuses comprises selectively blowing and not blowing individual e-fuses in each respective one of the plural phase shifter elements.

23. The method of claim 22, further comprising determining which ones of the e-fuses to blow and which ones of the e-fuses to not blow in each respective one of the plural phase shifter elements.

24. The method of claim 21, wherein the desired direction is defined by an azimuth angle and a polar angle.

25. The method of claim 21, wherein the desired direction is determined automatically using an actively tunable phase shifter that is separate and distinct from the plural phase shifters, and further comprising turning off the actively tunable phase shifter after the determining.

* * * * *